US010722908B2

(12) United States Patent
Kazama et al.

(10) Patent No.: US 10,722,908 B2
(45) Date of Patent: Jul. 28, 2020

(54) BELL CUP OF ROTARY ATOMIZATION TYPE COATING DEVICE

(71) Applicant: NISSAN MOTOR CO., LTD., Yokohama-shi, Kanagawa (JP)

(72) Inventors: Shigenori Kazama, Kanagawa (JP); Takeshi Goto, Kanagawa (JP); Takamitsu Ono, Kanagawa (JP); Masaaki Iwaya, Kanagawa (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 0 days.

(21) Appl. No.: 16/613,202

(22) PCT Filed: May 17, 2017

(86) PCT No.: PCT/JP2017/018487

§ 371 (c)(1),
(2) Date: Nov. 13, 2019

(87) PCT Pub. No.: WO2018/211618

PCT Pub. Date: Nov. 22, 2018

(65) Prior Publication Data

US 2020/0171518 A1 Jun. 4, 2020

(51) Int. Cl.

| | |
|---|---|
| ***B05B 5/04*** | (2006.01) |
| ***B05B 5/043*** | (2006.01) |
| ***B05B 15/55*** | (2018.01) |

(52) U.S. Cl.

CPC ..... *B05B 5/0407* (2013.01); *B05B 5/0418* (2013.01); *B05B 15/55* (2018.02); *B05B 5/043* (2013.01); *B05B 5/0426* (2013.01)

(58) Field of Classification Search

CPC ..... B05B 3/10; B05B 3/1007; B05B 3/1014; B05B 3/1064; B05B 5/0403;

(Continued)

(56) References Cited

U.S. PATENT DOCUMENTS 6,312,766 B1 * 11/2001 Pai ..... C23C 14/06 427/523
6,409,104 B1 * 6/2002 Fiala ..... B05B 5/0407 239/703

(Continued)

FOREIGN PATENT DOCUMENTS

JP 10-52657 A 2/1998
JP 2011-218673 A 11/2011

(Continued)

*Primary Examiner* — Darren W Gorman
(74) *Attorney, Agent, or Firm* — Foley & Lardner LLP

(57) ABSTRACT

A bell cup (3) of a rotary atomization-type coating device (1) is provided. This device has a rotary shaft (13) and a feed tube (15) inserted in the rotary shaft. The bell cup is fitted to a tip end part of the rotary shaft and has a coating material spreading surface (31) on an inner surface of the bell cup. The feed tube discharges a coating material to the coating material spreading surface. The coating material spreading surface includes a region extending from a predetermined position on a proximal end side to a distal end edge. The region is constituted of a convex curved surface toward an extension of the rotary shaft. The outermost surface of at least part (31B) of the coating material spreading surface is covered by a diamond-like carbon film (50) free from silicon at least on its outermost surface.

11 Claims, 9 Drawing Sheets

(58) Field of Classification Search
CPC ... B05B 5/0407; B05B 5/0418; B05B 5/0426; B05B 5/043; B05B 15/55
See application file for complete search history.

(56) References Cited

U.S. PATENT DOCUMENTS

| | | | | |
|---|---|---|---|---|
| 6,446,933 | B1 * | 9/2002 | Westmoreland | B29C 33/56 106/38.27 |
| 6,652,969 | B1 * | 11/2003 | Murakami | C23C 16/26 428/408 |
| 6,893,720 | B1 * | 5/2005 | Nakahigashi | C08J 7/06 138/137 |
| 8,512,864 | B2 * | 8/2013 | Konno | C23C 16/26 428/408 |
| 2011/0265717 | A1 | 11/2011 | Fritz et al. | |
| 2012/0305681 | A1 * | 12/2012 | Fritz | B05B 3/1014 239/589 |
| 2013/0284833 | A1 | 10/2013 | Fritz et al. | |
| 2017/0136481 | A1 | 5/2017 | Fritz et al. | |
| 2017/0239632 | A1 * | 8/2017 | Ito | H01M 4/1393 |

FOREIGN PATENT DOCUMENTS

| | | | |
|---|---|---|---|
| JP | 2012-508098 | A | 4/2012 |
| JP | 2013-530816 | A | 8/2013 |
| JP | 2015-194479 | A | 11/2015 |
| JP | 2016-036771 | A | 3/2016 |
| JP | 2016-79428 | A | 5/2016 |
| WO | WO 2010/006641 | A | 1/2010 |

* cited by examiner

BELL CUP OF ROTARY ATOMIZATION TYPE COATING DEVICE

TECHNICAL FIELD

The present invention relates to a bell cup of a rotary atomization-type coating device.

BACKGROUND ART

A bell cup of a rotary atomization-type coating device is known, in which the cup inner surface has a coating material spreading surface that is constituted of a convex curved surface toward the axis of rotation (Patent Document 1: JP1998-52657A). It is said that the use of this bell cup allows the particle diameter distribution of a coating material to be sharp.

PRIOR ART DOCUMENT

Patent Document

[Patent Document 1] JP1998-52657A

SUMMARY OF INVENTION

Problems to be Solved by Invention

However, when evaluating the atomization performance (average particle diameter) of coating materials using the above bell cup of the convex curved surface, the present inventors have found that the atomization performance of a low-viscosity coating material is lower than that of a high-viscosity coating material even under the same conditions of the composition, discharge rate, and rotation speed. This may lead to a problem in that the coating conditions including the rotation speed of the bell cup have to be made different depending on the viscosity of the coating material.

A problem to be solved by the present invention is to provide a bell cup of a rotary atomization-type coating device with which uniform atomization can be achieved regardless of the viscosity of a coating material.

Means for Solving Problems

The present invention solves the above problem by providing a bell cup in which a predetermined region of the coating material spreading surface is constituted of a convex curved surface toward the axis of rotation and the outermost surface of at least part of the coating material spreading surface is covered with a diamond-like carbon film, and the diamond-like carbon film is composed of amorphous carbon that is free from silicon and contains fluorine and in which carbon atoms on its surface are not terminated with fluorine atoms.

Effect of Invention

According to the present invention, water-repellent properties or oil-repellent properties of the diamond-like carbon film formed on the outermost surface of the bell cup suppress a waving phenomenon of the coating material on the coating material spreading surface. This can make the atomization uniform regardless of the coating material viscosity.

MODE(S) FOR CARRYING OUT THE INVENTION

Figure 1:
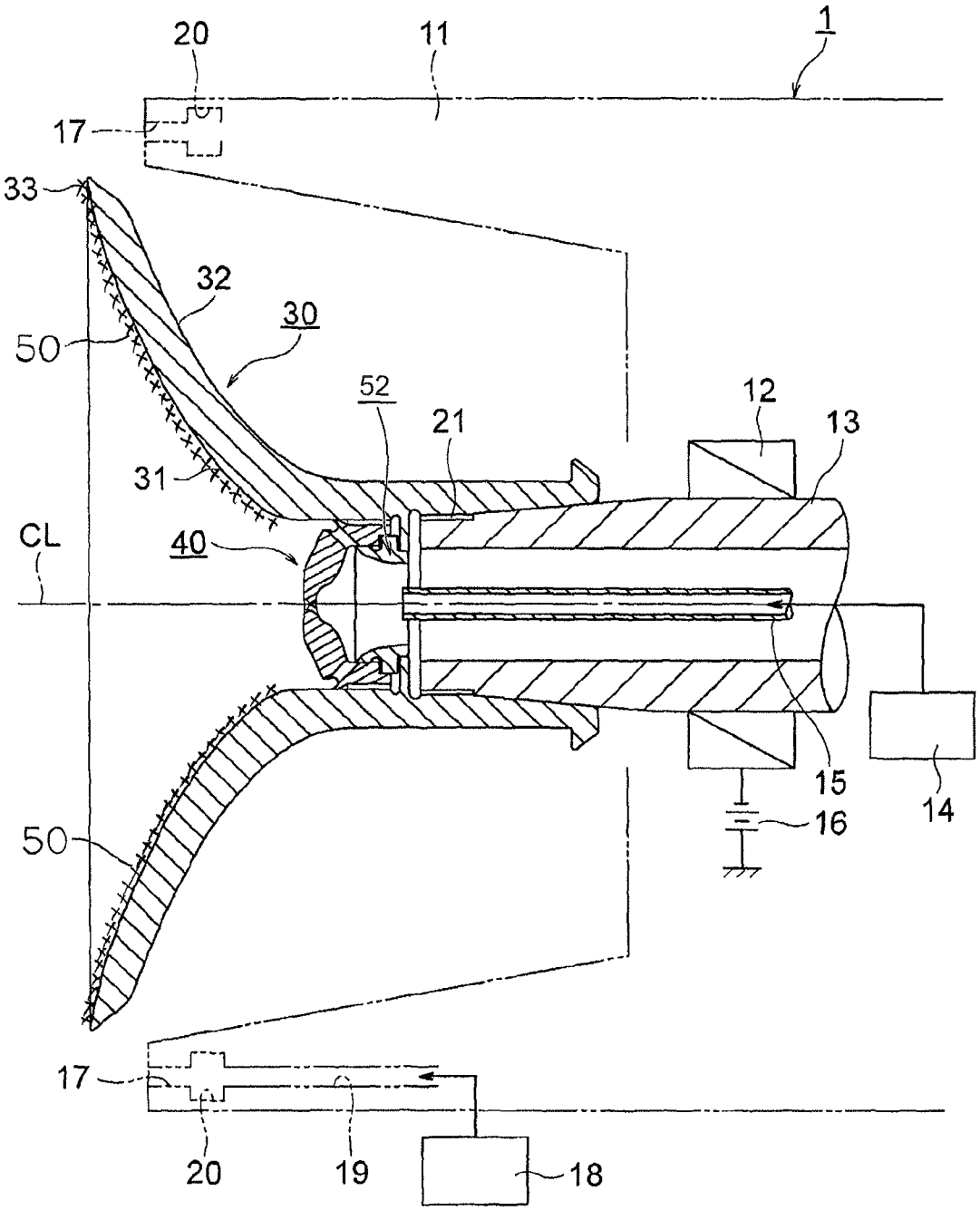
FIG. 1 is a cross-sectional view illustrating the distal end part of a rotary atomization-type coating device to which one or more embodiments of a bell cup according to the present invention are applied.
Figure 2:
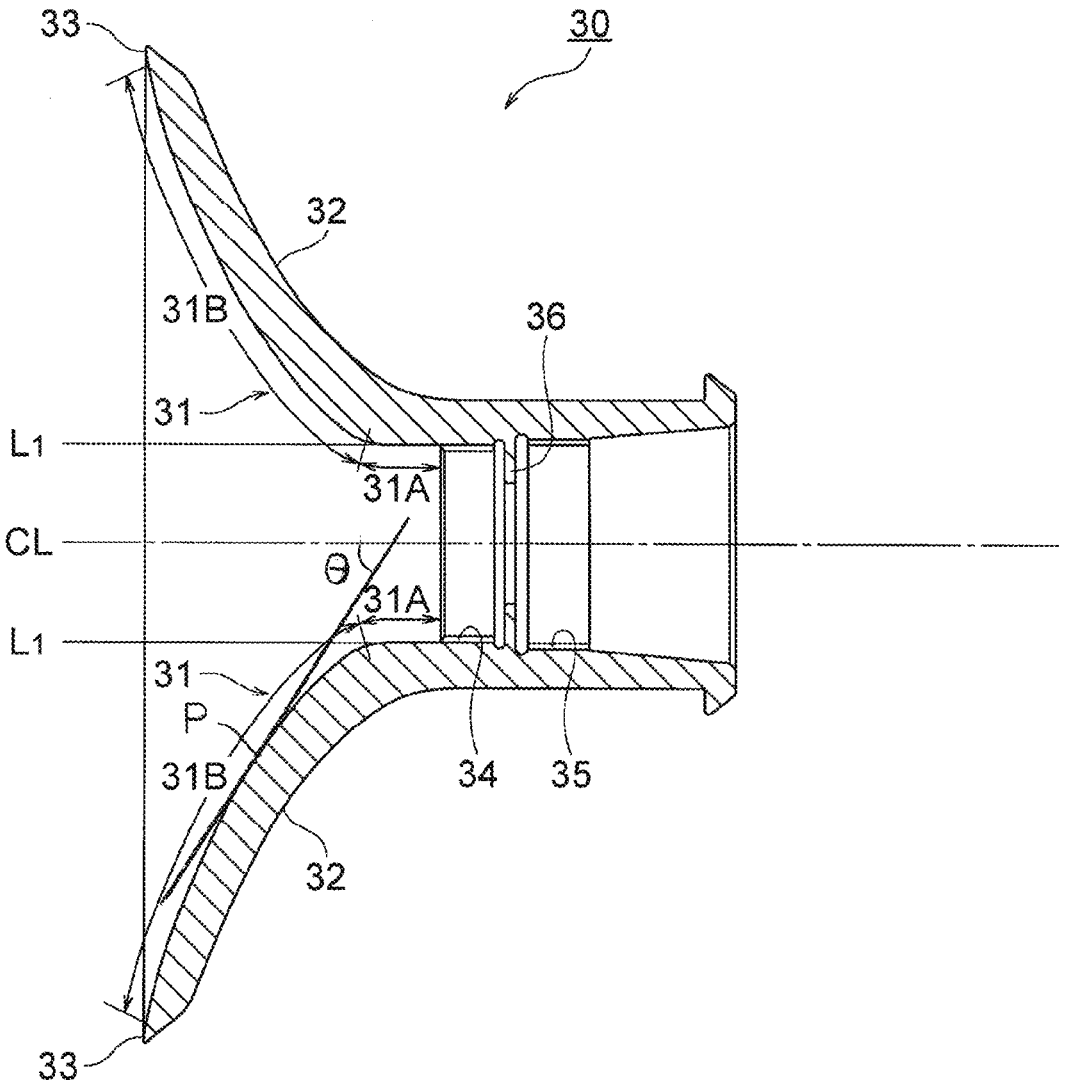
FIG. 2 is a cross-sectional view illustrating the bell cup of FIG. 1.
Figure 3:
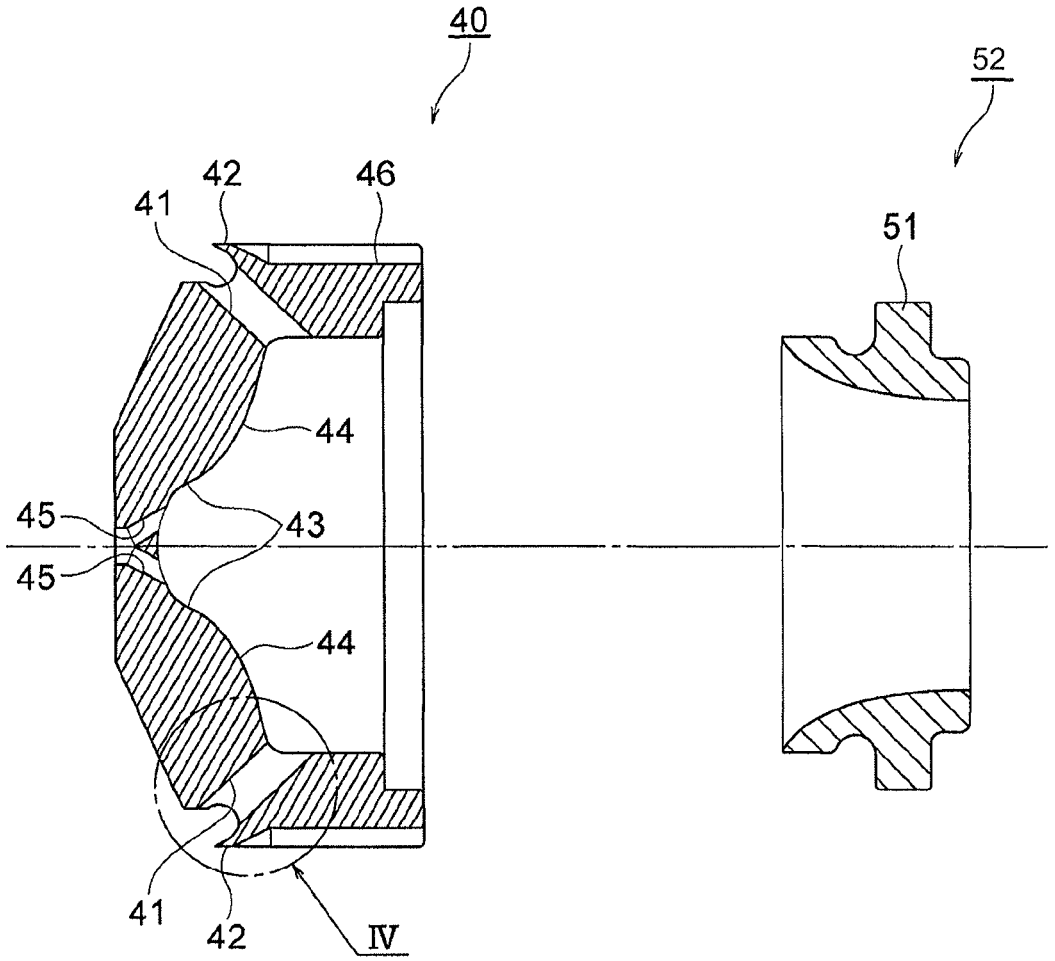
FIG. 3 is a cross-sectional view illustrating a bell hub and a spacer of FIG. 1.
Figure 4:
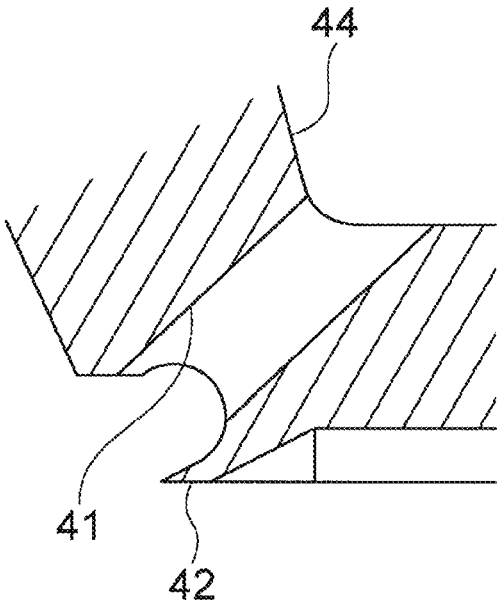
FIG. 4 is an enlarged cross-sectional view of part IV of FIG. 3.

Hereinafter, one or more embodiments of the present invention will be described with reference to the drawings. FIG. 1 is a cross-sectional view illustrating the distal end part of a rotary atomization-type coating device 1 to which one or more embodiments of a bell cup 3 according to the present invention are applied, FIG. 2 is a cross-sectional view illustrating a bell cup main body 30, FIG. 3 is a cross-sectional view illustrating a bell hub 40 and a spacer 52, and FIG. 4 is an enlarged cross-sectional view of part IV of FIG. 3. In the following description, the bell cup main body 30, the bell hub 40, and the spacer 52 will be collectively referred to as the bell cup 3. The bell cup 3 used in the rotary atomization-type coating device is also referred to as an atomization head or a spray head, but is referred to as the bell cup 3 in the present description. First, an example of the rotary atomization-type coating device 1 will be described with reference to FIG. 1. As used herein, the term "proximal end side" of the bell cup 3 refers to the side of a hollow shaft 13 of the rotary atomization-type coating device 1 while the term "distal end side" of the bell cup 3 refers to the side of an object to be coated. The bell cup 3 according to one or more embodiments of the present invention can be applied not only to the rotary atomization-type coating device 1 having a structure described below but also to a rotary atomization-type coating device having another structure.

The rotary atomization-type coating device 1 illustrated in FIG. 1, which is an electrostatic coating device, has a housing 11 formed of an electrically insulating material and the hollow shaft 13 provided inside the housing 11. The hollow shaft 13 is rotated by an air motor 12 provided in the housing 11. The bell cup 3 for spraying a coating material is fixed to the tip end of the hollow shaft 13 by fastening a screw part 35 of the bell cup 3 (see FIG. 2) to a screw part 21 of the hollow shaft 13 illustrated in FIG. 1 and is driven so as to rotate together with the hollow shaft 13. A non-rotating hollow feed tube 15 is disposed in the center bore of the hollow shaft 13. The feed tube 15 feeds the bell cup 3 with the coating material and/or cleaning thinner supplied from a coating material supply device 14. The outer circumference of the back surface of the bell cup 3 is surrounded by the distal end of the housing 11.

The rotary atomization-type coating device 1 operates in such a manner that coating material particles having been charged by application of voltage from a high-voltage power supply 16 travel in the air along an electrostatic field formed between the device and an object to be coated and the object is coated with the coating material particles. Although not illustrated, the object to be coated is located on the left side of FIG. 1 with a predetermined gun distance from the device and grounded via a coating carriage or a coating hanger. As the method of applying a high voltage, an internal application type can be employed in which, as illustrated in FIG. 1, the high-voltage power supply 16 is provided in the housing 11 and the voltage is applied, via the hollow shaft 13 composed of an electrically conductive material, to the bell cup main body 30 which is also composed of an electrically conductive material. Alternatively, when the bell cup main body 30 is composed of an electrically insulating material, an rotary atomization-type electrostatic coating device of an external application type can be employed, in which a discharge electrode connected to a high-voltage power supply is provided around the bell cup main body 30 and the voltage is applied to the coating particles released from the bell cup main body 30.

The rotary atomization-type coating device 1 operates to discharge an air flow referred to as shaping air from air ejection ports 17 disposed on the back surface side of the bell cup main body 30 and deflect the coating material particles, which are atomized by the bell cup main body 30, in a direction toward the object located ahead of the bell cup main body 30. To this end, part of the housing 11 is formed with an air passage 19 connected to an air supply device 18, and the distal end of the housing 11 is formed with an annular air passage 20 communicating with the air passage 19. The air ejection ports 17, which communicate with the annular air passage 22, are formed at predetermined intervals along the distal end circumferential surface of the housing 11. By adjusting the flow rate and blowing angle of the shaping air blown from the air ejection ports 17, the traveling direction of the coating material particles released from the distal end of the bell cup main body 30 in the tangent direction, that is, the coating pattern, can be controlled. The coating material particles are given kinetic momentum caused by the shaping air in addition to the force caused by the above-described electrostatic field. The air ejection ports 17 for the shaping air illustrated in FIG. 1 are provided in a single annular row, but may also be provided in two or more rows in order to adjust the blowing angle of the shaping air.

The tip end of the feed tube 15 protrudes from the tip end of the hollow shaft 13 and extends toward the interior of the bell cup main body 30. The feed tube 15 is supplied with the coating material or cleaning thinner from the coating material supply device 14 and feeds the coating material or cleaning thinner to a coating material spreading surface 31 of the bell cup main body 30 from the tip end of the feed tube 15. The cleaning thinner is a cleaning liquid (in the case of an organic solvent-based coating material, an organic solvent, or in the case of an aqueous coating material, water) for cleaning the coating material spreading surface 31 of the bell cup main body 30 and the bell hub 40, which will be described later. When the rotary atomization-type coating device 1 of this example is applied to a top coat coating process or a middle coat coating process, which requires a color switching operation, the cleaning thinner is supplied for the purpose of cleaning when switching the color of the coating material. Accordingly, in coating processes in which color switching operations are not needed, such as a middle coat coating process involving the coating only with a single type of middle coat coating material, for example, the feed tube 15 may be supplied only with the coating material. Color switching operations are carried out using a color switching valve unit, such as a color change valve, not illustrated, which is included in the coating material supply device 14.

The bell cup main body 30 of this example is composed of a conductive material such as aluminum, an aluminum alloy, titanium, a titanium alloy, a stainless alloy, or other metal material. However, the bell cup main body 30 applied to the above-described rotary atomization-type electrostatic coating device of an external application type may be composed of a hard resin material. The bell cup main body 30 of this example is approximately cup shaped and has the coating material spreading surface 31 of the cup-shaped inner surface, a cup-shaped outer surface 32, and a distal end edge 33 located at the distal end of the inner surface, from which the coating material is released. The configuration of the coating material spreading surface 31 will be described later.

The bell hub 40 is attached to the center on the proximal end side of the bell cup main body 30 in the vicinity of the tip end of the feed tube 15. This bell hub 40 can be composed of an electrically conductive material such as metal or an electrically insulating material such as a resin, but may more preferably be composed of a resin material. The bell hub 40 of this example is fixed by fastening a screw part 46 illustrated in FIG. 3 to a screw part 34 formed on the proximal end inner surface of the bell cup main body 30 illustrated in FIG. 2 and rotates together with the bell cup main body 30 and the hollow shaft 13. Alternatively, the bell hub 40 may be fitted to the tip end of the hollow shaft 13 or may also be fitted to the tip end of the feed tube 15 so as not to rotate.

As the bell cup main body 30 is circular centered on a rotation center axis CL (including an extension of the center line of the hollow shall 13 as a rotary shaft) in the front view, the bell hub 40 is also circular in the front view. The outer circumferential part of the bell hub 40 is formed with a plurality of through holes 41 at predetermined intervals, and the coating material or cleaning thinner fed from the tip end of the feed tube 15 passes through the through holes 41 of the bell hub 40 and is guided onto the coating material spreading surface 31 of the bell cup main body 30 and then sprayed from the entire circumference of the distal end edge 33.

The bell hub 40 of this example is fixed to the proximal end part of the bell cup main body 30 by screw fastening in a state in which the spacer 52 is interposed between the bell hub 40 and the bell cup main body 30. As illustrated in FIG. 3, the spacer 52 has an annular convex part 51. The annular convex part 51 abuts against an annular convex part 36 formed at the proximal end part of the bell cup main body 30, and the spacer 52 is thereby clamped between the bell hub 40 and the proximal end part of the bell cup main body 30. The spacer 52 can be composed of a conductive material such as metal or an electrically insulating material such as a resin. The spacer 52 may be omitted if unnecessary.

Configurations of the coating material spreading surface 31 of the bell cup main body 30 and the bell hub 40 in this example will then be described.

FIG. 2 is an enlarged cross-sectional view of the bell cup main body 30 as a single body illustrated in FIG. 1. The bell cup main body 30 of this example has the coating material spreading surface 31 which is rotationally symmetric about the rotation center axis CL of the hollow shaft 13. This coating material spreading surface 111 is constituted of a continuous curved surface having a start point and an end point. The start point is located at a position on the proximal end side of the inner surface of the bell cup main body 30, specifically, a position facing any of the through holes 41 from which the coating material is discharged. The end point is located at a position of the distal end edge 33 of the inner surface of the bell cup main body 30. It is intended that these terms "start point" and "end point" represent points along the direction of flow of the coating material discharged from the feed tube 15, meaning that the two ends of the coating material spreading surface 31 are defined by the position of any of the through holes 41 and the distal end edge 33 of the inner surface of the bell cup main body 30.

In particular, the coating material spreading surface 31 of this example includes a first region 31A that extends to the proximal end part including the start point facing any of the through holes 41 and a second region 31B that merges into the first region 31A and extends to the distal end edge 33 of the bell cup main body 30. The first region 31A is constituted of a curved surface that forms an angle of more than 0° and less than 5° with the rotation center axis CL, while the second region 31B is constituted of a convex curved surface toward the rotation center axis CL. The coating material spreading surface within the first region 31A may also be referred to as a first coating material spreading surface 31A, and the coating material spreading surface within the second region 31B may also be referred to as a second coating material spreading surface 31B. As illustrated in FIG. 2, the curved surface of the first coating material spreading surface 31A of the first region is in a side surface shape of a substantially parallel cylindrical body or of an expanding circular truncated cone toward the distal end side. In this shape, an angle $\alpha$ formed between the rotation center axis CL and a straight line L1 passing through the first coating material spreading surface 31A satisfies $0° < \alpha < 5°$ in the cross section at an arbitrary plane including the rotation center axis CL of the hollow shaft 13.

If the angle $\alpha$ formed between the rotation center axis CL and the straight line L1 passing through the first coating material spreading surface 31A is 0°, the coating material or cleaning thinner discharged onto the first coating material spreading surface 31A is less likely to flow to the second coating material spreading surface 31B even with the centrifugal force due to the rotation of the bell cup main body 30. If the angle $\alpha$ formed between the rotation center axis CL and the straight line L1 passing through the first coating material spreading surface 31A is less than 0°, that is, if the curved surface of the first coating material spreading surface 31A of the first region is in a side surface shape of an expanding circular truncated cone toward the proximal end side, the coating material or cleaning thinner discharged onto the first coating material spreading surface 31A is likely to flow adversely toward the proximal end part of the bell cup main body 30 with the centrifugal force due to the rotation of the bell cup main body 30. On the other hand, if the angle $\alpha$ formed between the rotation center axis CL and the straight line L1 passing through the first coating material spreading surface 31A is 5° or more, the coating material accumulation effect described below cannot readily be obtained. Accordingly, the angle $\alpha$ formed between the rotation center axis CL and the straight line L1 passing through the first coating material spreading surface 31A preferably satisfies $0° < \alpha < 5°$.

The curved surface of the second coating material spreading surface 31B of the second region is formed as a convex curved surface toward the rotation center axis CL, that is, a curved surface on which the angle formed between the rotation center axis CL and the tangent line to the curved surface increases gradually toward the distal end edge 33 of the bell cup main body 30. Although not particularly limited, as illustrated in FIG. 2, for example, when the angle (angle on the acute angle side: acute angle) between the rotation center axis CL and the tangent line to a point P on the second coating material spreading surface 31B of the second region is 0, the angle $\theta$ at the start point of the second coating material spreading surface 31B of the second region (i.e., the angle $\theta$ at the boundary portion with the first coating material spreading surface 31A) is 60°, and the angle $\theta$ at the end point of the second coating material spreading surface 31B (i.e., the angle $\theta$ at the distal end edge of the bell cup main body 30) is 90°. The boundary portion between the first coating material spreading surface 31A and the second coating material spreading surface 31B is formed as a curved surface that varies smoothly. Although not illustrated in detail, the end point of the second coating material spreading surface 31B, that is, the distal end edge of the bell cup main body 30, is formed with a plurality of grooves in the radial direction. The coating material spread on the second coating material spreading surface 31B is distributed by the large number of grooves and released in a thread-like form.

On the other hand, as illustrated in FIG. 3 and FIG. 4, the bell hub 40 is formed with a skirt part 42 at the distal end part which is the outlet of each of the through holes 41. The skirt part 42 is formed to approach smoothly and gradually from the through holes 41 toward the first coating material spreading surface 31A. The skirt part 42 alleviates the collision of the coating material discharged from the through holes 41 with the first coating material spreading surface 31A. In the inner surface of the bell hub 40, the inner surface of the central part facing the tip end of the feed tube 15, including the rotation center axis CL, is formed as a concave curved surface 43 that faces the proximal end of the bell cup main body 30. On the other hand, the outer circumferential part of the inner surface of the bell hub 40 is formed as a convex curved surface 44 that merges into to the concave curved surface 43 and faces the proximal end of the bell cup main body 30. The concave curved surface 43 and the convex curved surface 44 modify the flow direction of the coating material discharged from the feed tube 15 thereby to reduce the speed of the coating material. This limits the flow velocity of the coating material when reaching the through holes 41, so that the energy of collision with the first coating material spreading surface 31A is reduced. Note, however, that the skirt part 42, the concave curved surface 43, and the convex curved surface 44 are not essential features of the present invention and may be omitted if unnecessary.

The central part of the bell hub 40 is formed with a plurality of cleaning holes 45. The cleaning holes 45 have respective openings at the inner surface of the bell hub 40 and merge into a single opening at the outer surface of the bell hub 40. That is, each cleaning hole 45 is a hole inclined toward the rotation center axis CL, in other words, a hole inclined in the diameter reducing direction toward the distal end of the bell cup 3. The cleaning holes 45 of this example are used when cleaning the bell cup main body 30 and the outer surface of the bell hub 40 with the cleaning thinner.

When the cleaning thinner is fed from the feed tube 15 in a state in which the rotation speed of the bell cup 3 is set low, large centrifugal force does not act on the cleaning thinner discharged onto the inner surface of the bell hub 40. Accordingly, part of the cleaning thinner reaches the outer surface of the bell hub 40 through the cleaning holes 45 and can clean the outer surface of the bell hub 40. However, when the bell cup 3 is rotated at a high speed, such as during the coating with the coating material, the coating material discharged onto the inner surface of the bell hub 40 does not reach the outer surface of the bell hub 40 via the washing holes 45 by virtue of the centrifugal force and the reverse inclination of the washing holes 45.

The present inventors have found that, when the coating is performed using the bell cup 3 having the second coating material spreading surface 31B formed as that type of convex curved surface, the viscosity of the coating material to be used significantly affects the average particle diameter. That is, the obtained knowledge is that, when two types of clear coating materials having different coating material viscosities are atomized at the same discharge rate and the same rotation speed, the average particle diameters of the obtained atomized particles are different and, in particular, the higher-viscosity coating material exhibits higher atomization performance than that of the lower-viscosity coating material. This means that the higher-viscosity coating material is atomized with a smaller average particle diameter. Specifically, the mass-average particle diameter of the clear coating material having a kinematic viscosity of 100 mPa·s was 58 μm, while the mass-average particle diameter of the clear coating material having a kinematic viscosity of 80 mPa·s was 70 μm. The conventional common sense is that the lower-viscosity coating material has higher atomization performance, but in this knowledge, the higher-viscosity coating material has higher atomization performance, which is the opposite result to the conventional common sense.

This means that, when the coating is performed using the bell cup 3 of the convex curved surface, the difference in the viscosity causes the atomization performance to differ even under the same conditions of the composition, discharge rate, and rotation speed. If so, a problem arises in that the coating conditions including the rotation speed of the bell cup 3 have to be made different depending on the viscosity at the time of coating. For example, in the above-described specific example, to reduce the mass-average particle diameter from 70 μm to 58 μm, the coating with this lower-viscosity coating material has to be performed at a higher rotation speed than that for the higher-viscosity coating material by about 10,000 rpm. As will be understood, it is technically possible to control the rotation speed of the bell cup 3 in accordance with the coating material viscosity, but in this case the rotation speed of the bell cup 3 has to be controlled while detecting the coating material viscosity in real time and the control thus becomes complicated because the coating material viscosity varies depending on the temperature.

Figure 5A:
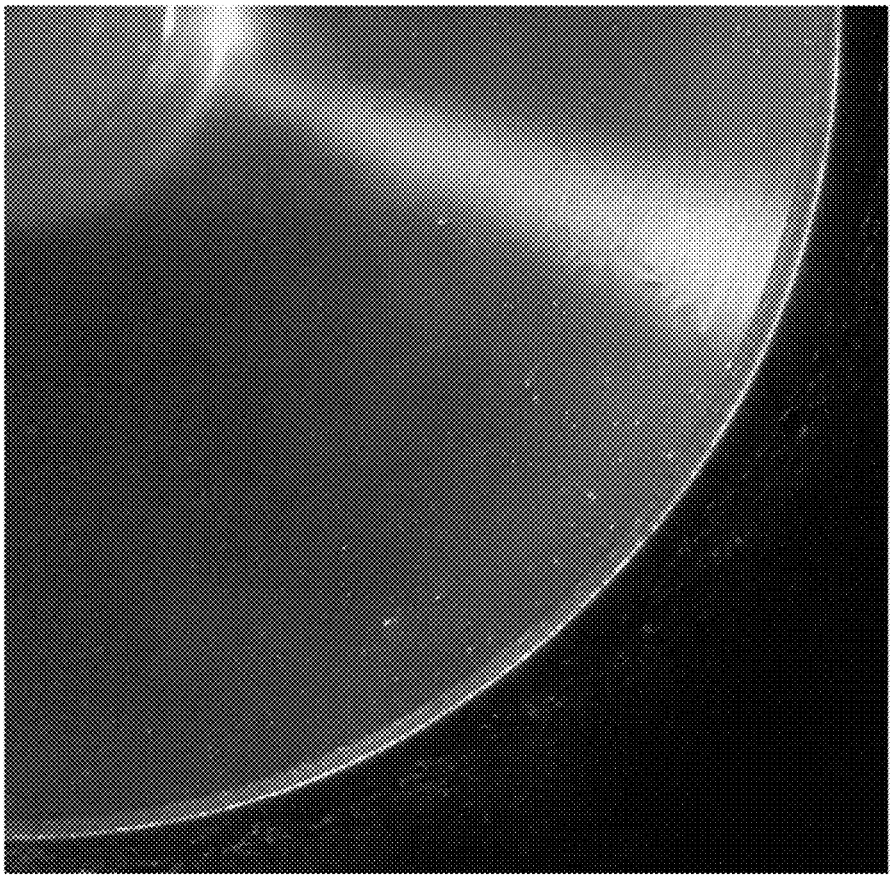
FIG. 5A is a photograph of a conventional bell cup taken when performing the coating with a high-viscosity clear coating material using the bell cup.
Figure 5B:
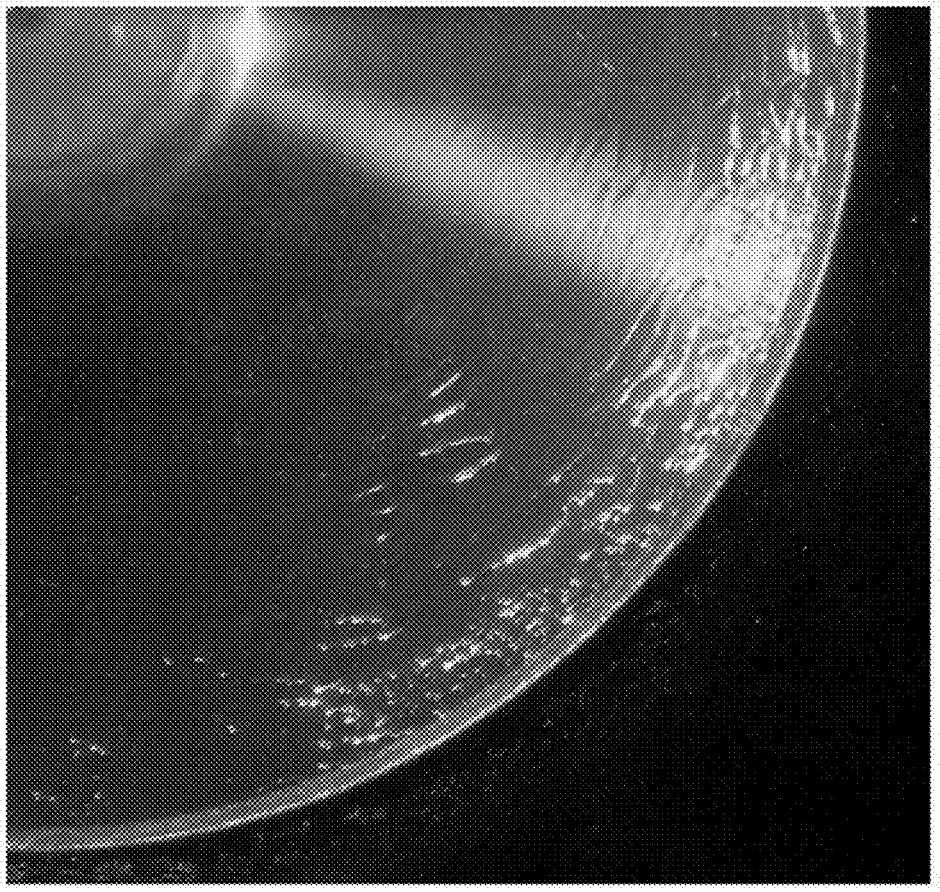
FIG. 5B is a photograph of the conventional bell cup taken when performing the coating with a low-viscosity clear coating material using the bell cup.

FIG. 5A is a photograph of the coating material spreading surface 31 of the bell cup main body 30 taken when performing the coating with a clear coating material having a kinematic viscosity of 100 mPa·s at 25,000 rpm using the bell cup main body 30 having the second coating material spreading surface 31B formed as a convex curved surface illustrated in FIG. 1 and FIG. 2, and FIG. 5B is a photograph of the coating material spreading surface 31 of the bell cup main body 30 taken when performing the coating with a clear coating material having a kinematic viscosity of 80 mPa·s at the same rotation speed using the same bell cup main body 30. In the higher-viscosity coating material shown in FIG. 5A, the coating material flowing on the second coating material spreading surface 31B is smooth, but in the lower-viscosity coating material shown in FIG. 5B, a large waving phenomenon (which appears in white color) can be observed occurring in the vicinity of the end point of the second coating material spreading surface 31B.

The reason that such a waving phenomenon occurs appears to be because the speed of the coating liquid is significantly different between the bottom part of the coating liquid at the interface with the bell cup surface and the surface part of the coating liquid. In the case of the higher-viscosity coating material, the difference in speed is less likely to occur in the coating liquid itself, so no waving phenomenon is observed, while in the case of the lower-viscosity coating material, the difference in speed is more likely to occur in the thickness direction of the coating liquid, so this is because the waving phenomenon is observed. The flow of the coating liquid film on the second coating material spreading surface 31B of the bell cup main body 30 is preferably a laminar flow. However, depending on the properties of the coating material, particularly in a lower-viscosity coating material, the speed difference occurs between the bottom part and the surface part of the coating material liquid, which causes the waving phenomenon on numerous sites of the second coating material spreading surface 31B. This waving phenomenon leads to variation in the amount of coating material supplied to the large number of grooves provided near the outermost circumference of the bell cup main body 30 and appears as a phenomenon that the tops of waves get across walls between the grooves and are released as a film-like liquid rather than a thread-like liquid. If the coating material is released as a film-like liquid from the distal end edge of the bell cup main body 30, the shaping air supplied from the back surface of the bell cup main body 30 is entrained as air bubbles in the coating material, which then adheres to the object to be coated and may readily generate coating film defects similar to the foaming phenomenon on the coating surface.

To overcome such problems, in the bell cup main body 30 of this example, the outermost surface of at least part of the coating material spreading surface 31 is covered with a diamond-like carbon film 50 free from silicon at least on its outermost surface. As indicated by crosses in FIG. 1, the diamond-like carbon film 50 of this example is preferably provided on the entire outermost surface of the second coating material spreading surface 31B included in the coating material spreading surface 31. Alternatively, the diamond-like carbon film 50 is preferably provided on the entire outermost surface of the coating material spreading surface 31 at which the acute angle θ formed between the tangent line to the coating material spreading surface 31 and the rotation center axis CL is 60° to 90°. The diamond-like carbon film 50 may of course be provided on the first coating material spreading surface 31A of the coating material spreading surface 31 in addition to the above.

The diamond-like carbon film 50 of this example is composed of diamond-like carbon (DLC) that is an amorphous material having both the $SP^3$ bond of diamond and the $SP^2$ bond of graphite as the skeleton structures of carbon atoms. In particular, the diamond-like carbon film 50 of this example is preferably composed of (a) diamond-like carbon that is hydrogenated amorphous carbon containing hydrogen and in which carbon atoms on its surface are terminated with hydrogen atoms, (b) diamond-like carbon that is hydrogenated amorphous carbon containing hydrogen and in which carbon atoms on its surface are not terminated with hydrogen atoms, or (c) diamond-like carbon that is amorphous carbon containing fluorine and in which carbon atoms on its surface are not terminated with fluorine atoms. As will be described later, a diamond-like carbon film composed of amorphous carbon that is diamond-like carbon but contains silicon Si is not preferred because the effect of the present invention of absorbing the viscosity difference of coating materials may not be exhibited.

The diamond-like carbon film 50 of this example can be formed on the bell cup main body 30 by a chemical vapor deposition method (CVD method) in which the film is formed from plasma of a hydrocarbon-based gas such as $CH_4$ or $C_2H_2$ or a physical vapor deposition method (PVD method) in which the film is formed from solid carbon using sputtering or cathodic arc discharge. The diamond-like carbon film 50 of this example contains hydrogen or fluorine as described in the above (a) to (c) and can therefore be readily formed by the CVD method. It suffices that the diamond-like carbon film 50 of this example has a film thickness that allows the film to exhibit water-repellent properties to an aqueous coating material as the coating material to be applied or oil-repellent properties to an organic solvent-based coating material as the coating material to be applied. Although not particularly limited, the film thickness is 0.2 μm to 2.0 μm.

It is to be noted that the diamond-like carbon film 50 cannot be directly formed on a general iron-based material. This is because the wettability with iron is low and it is difficult to form a carbide layer at the interface, thus the film may readily delaminate. Accordingly, when the bell cup main body 30 is composed of the above-described aluminum, aluminum alloy, titanium, titanium alloy, stainless steel alloy, or other metal material, it is preferred to form an electroless plating film of metal such as nickel, a metal oxide film, or a silicon-containing diamond-like carbon film as an intermediate layer on the surface of the bell cup main body 30 and then form the diamond-like carbon film 50 of this example on the surface of the intermediate layer.

As described above, in the bell cup 3 according to one or more embodiments of the present invention, the diamond-like carbon film 50 composed of any of (a) diamond-like carbon that is hydrogenated amorphous carbon containing hydrogen and in which carbon atoms on its surface are terminated with hydrogen atoms, (b) diamond-like carbon that is hydrogenated amorphous carbon containing hydrogen and in which carbon atoms on its surface are not terminated with hydrogen atoms, and (c) diamond-like carbon that is amorphous carbon containing fluorine and in which carbon atoms on its surface are not terminated with fluorine atoms is formed at least on the outermost surface of the second coating material spreading surface 31B or on the outermost surface of the coating material spreading surface 31 at which the acute angle θ formed between the tangent line to the coating material spreading surface 31 and the rotation center axis CL is 60° to 90° and, therefore, the water-repellent properties or oil-repellent properties are exhibited to the coating material spreading from the proximal end side to the distal end side of the coating material spreading surface 31. This reduces the speed difference between the bottom part and the surface part of the coating material, and the occurrence of the waving phenomenon as shown in FIG. 5B is therefore suppressed. As a result, the atomization performance can be made uniform regardless of the coating material viscosity, and the coating can thus be performed under the same coating condition.

EXAMPLES

Example 1

The surface of the coating material spreading surface 31 of the bell cup 3 illustrated in FIG. 2 was subjected to electroless nickel plating, and the diamond-like carbon film 50 composed of (a) diamond-like carbon that is hydrogenated amorphous carbon containing hydrogen and in which carbon atoms on its surface are terminated with hydrogen atoms was formed on the surface of the nickel-plated coating material spreading surface 31. Using the rotary atomization-type coating device 1 illustrated in FIG. 1 including the bell cup 3, coating with three types of clear coating materials: an organic solvent-based clear coating material having a kinematic viscosity of 120 mPa·s (SUPERLAC 0-80 available from NIPPON PAINT AUTOMOTIVE COATINGS CO., LTD.); an organic solvent-based clear coating material having a kinematic viscosity of 100 mPa·s (SUPERLAC 0-80 available from NIPPON PAINT AUTOMOTIVE COATINGS CO., LTD.); and an organic solvent-based clear coating material having a kinematic viscosity of 80 mPa·s (MACFLOW 0-590 available from NIPPON PAINT AUTOMOTIVE COATINGS CO., LTD.) was performed at a discharge rate of 550 ml/min and a rotation speed of the bell cup main body 30 of 25,000 rpm.

Figure 6A:
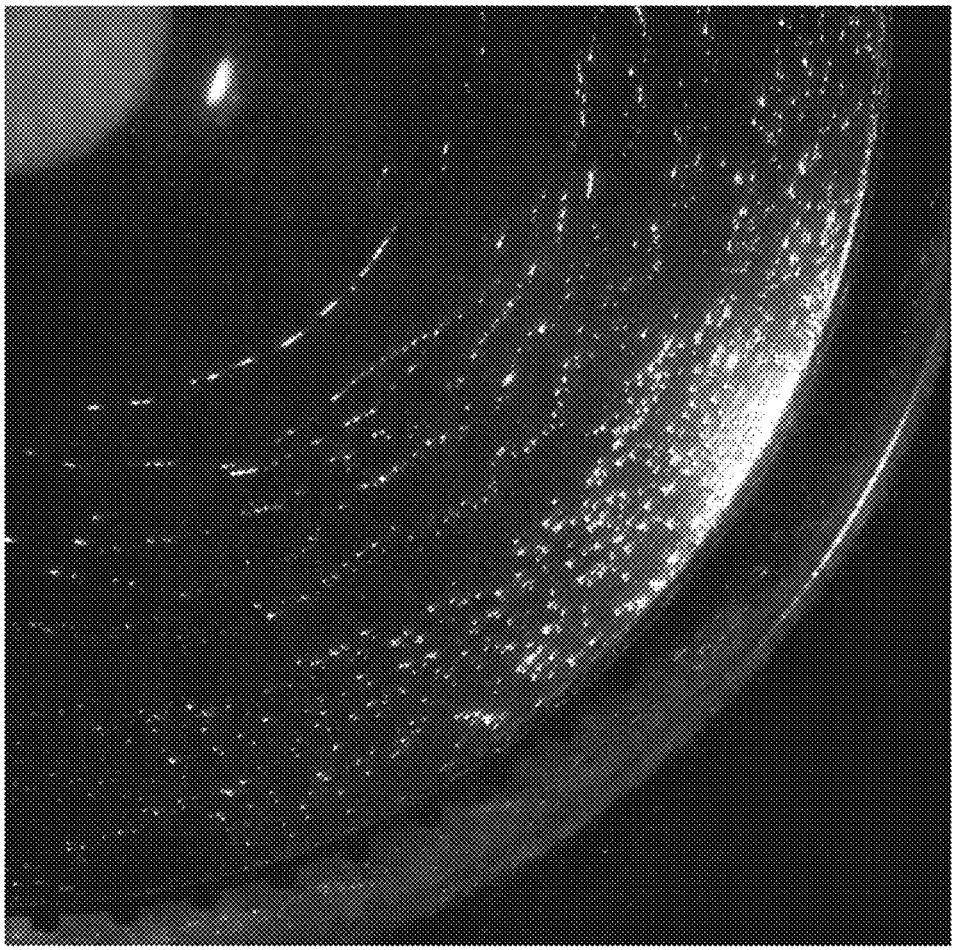
FIG. 6A is a photograph of a bell cup of Example 1 taken when performing the coating with the high-viscosity clear coating material using the bell cup.
Figure 6B:
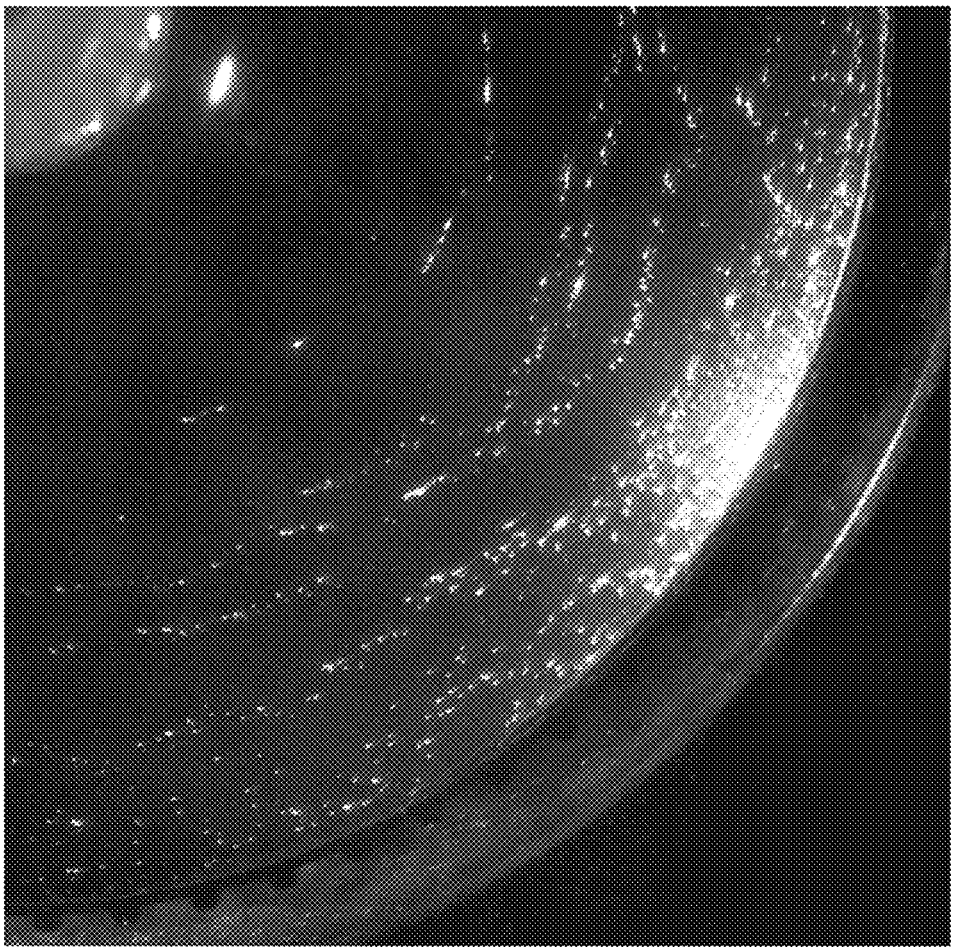
FIG. 6B is a photograph of the bell cup of Example 1 taken when performing the coating with the low-viscosity clear coating material using the bell cup.

FIG. 6A is a photograph of the coating material spreading surface 31 of the bell cup main body 30 taken when performing the coating with the above clear coating material of Example 1 having a kinematic viscosity of 100 mPa·s at 25,000 rpm, and FIG. 6B is a photograph of the coating material spreading surface 31 of the bell cup main body 30 taken when performing the coating with the clear coating material of Example 1 having a kinematic viscosity of 80 mPa·s at the same rotation speed using the same bell cup main body 30. As shown in FIG. 6A and FIG. 6B, a large number of fine waves are generated regardless of the viscosity difference, but the difference from FIG. 5B is that the waves change to sufficiently small waves until reaching the outermost circumferential part of the bell cup and it can be observed that large waves getting across the peaks of the grooves at the distal end edge of the bell cup have disappeared.

In Example 1 above, the average particle diameters of the three types of clear coating materials at the time of coating were measured. The method of measuring the average particle diameters includes forming a so-called spray pattern ahead of the rotary atomization-type coating device 1, moving a prepared glass plate to traverse and cross the spray pattern, and performing image processing to measure the particle diameter of the coating material particles collected on the glass plate. The measured average particle diameters are listed in Table 1. The average particle diameter is represented by a mass-average particle diameter (D43). This mass-average particle diameter is a physical quantity indicative of how small, on average, the diameter of particles in the coating film is when the total amount of particle cloud of the spray pattern adheres to the object to be coated. The smaller the numerical value, the better the atomization state is.

Example 2

Coating was performed under the same condition as in Example 1 except that the diamond-like carbon film 50 was composed of (b) diamond-like carbon that is hydrogenated amorphous carbon containing hydrogen and in which carbon atoms on its surface are not terminated with hydrogen atoms.

The average particle diameters (mass-average particle diameters, D43) of the three types of clear coating materials at the time of coating are listed in Table 1.

Example 3

Coating was performed under the same condition as in Example 1 except that the diamond-like carbon film 50 was composed of (c) diamond-like carbon that is amorphous carbon containing fluorine and in which carbon atoms on its surface are not terminated with fluorine atoms. The average particle diameters (mass-average particle diameters, D43) of the three types of clear coating materials at the time of coating are listed in Table 1.

Comparative Example 1

Coating was performed under the same condition as in Example 1 except that an electroless nickel plating film (Ni) was formed on the surface of the coating material spreading surface 31 of the bell cup 3 as substitute for the diamond-like carbon film 50. The average particle diameters (mass-average particle diameters, D43) of the three types of clear coating materials at the time of coating are listed in Table 1.

Comparative Example 2

Coating was performed under the same condition as in Example 1 except that a chromium nitride film (CrN) was formed on the surface of the coating material spreading surface 31 of the bell cup 3 as substitute for the diamond-like carbon film 50. The average particle diameters (mass-average particle diameters, D43) of the three types of clear coating materials at the time of coating are listed in Table 1.

Comparative Example 3

Coating was performed under the same condition as in Example 1 except that a diamond-like carbon film composed of diamond-like carbon that is amorphous carbon containing silicon and in which silicon atoms are exposed on its surface was formed on the surface of the coating material spreading surface 31 of the bell cup 3 as substitute for the diamond-like carbon film 50. The average particle diameters (mass-average particle diameters, D43) of the three types of clear coating materials at the time of coating are listed in Table 1.

TABLE 1

| | 120 mPa · s | 100 mPa · s | 80 mPa · s | Particle diameter difference μm | Determination |
|---|---|---|---|---|---|
| Example 1 | 58 | 57 | 60 | 3 | OK |
| Example 2 | 60 | 62 | 58 | 4 | OK |
| Example 3 | 61 | 58 | 59 | 3 | OK |
| Comparative Example 1 | 67 | 57 | 70 | 13 | NG |
| Comparative Example 2 | 70 | 59 | 67 | 11 | NG |
| Comparative Example 3 | 76 | 69 | 62 | 14 | NO |

From the results of Table 1, it has been confirmed that, in Examples 1 to 3, the average particle diameter difference when performing the coating under the same condition is only 3 to 4 μm even with different kinematic viscosities of 80 to 120 mPa·s whereas, with regard to the bell cup in Comparative Examples 1 to 3, the average particle diameter difference is 11 to 14 μm, which is not negligible.

Figure 7:
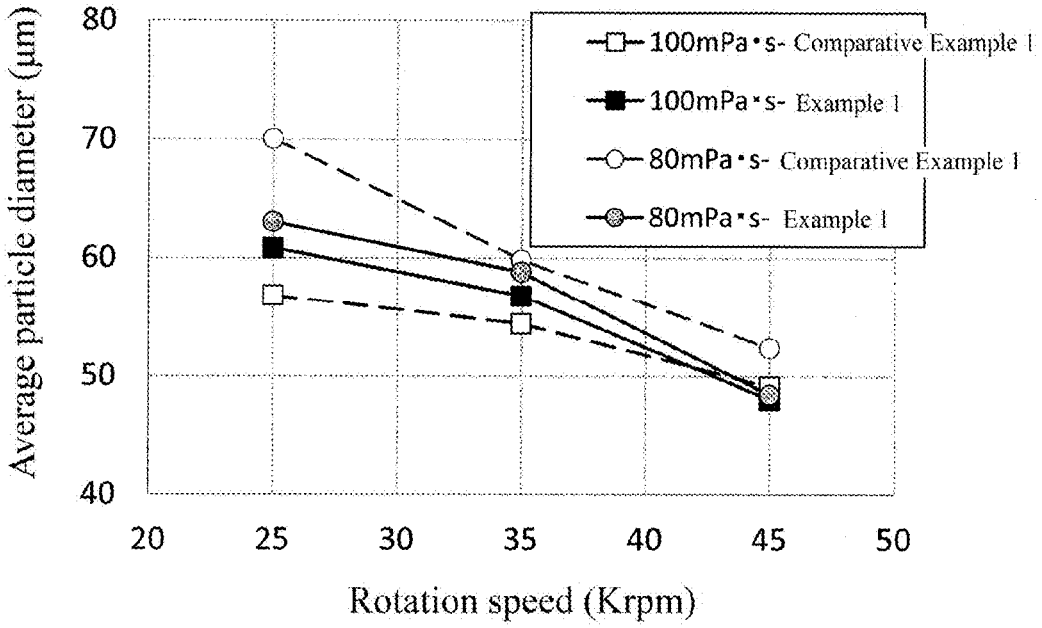
FIG. 7 is a graph illustrating measurement results of average particle diameters with respect to the rotation speed when performing the coating with the coating materials having different viscosities using the bell cups of Example 1 and Comparative Example 1.

For the organic solvent-based clear coating material having a kinematic viscosity of 100 mPa·s and organic solvent-based clear coating material having a kinematic viscosity of 80 mPa·s in Example 1 and the organic solvent-based clear coating material having a kinematic viscosity of 100 mPa·s and organic solvent-based clear coating material having a kinematic viscosity of 80 mPa·s in Comparative Example 1, the average particle diameters (mass-average particle diameters, D43) when the rotation speed of the bell cup main body 30 was 25,000 rpm, 35,000 rpm, and 45,000 rpm were measured. The results are illustrated in FIG. 7. The average particle diameter of the vertical axis indicates the existence ratio in the volume ratio.

From the results of FIG. 7, even when the rotation speed of the bell cup main body 30 varies from 25,000 to 45,000 rpm, the average particle diameter difference is small in the bell cup of Example 1 regardless of the coating material viscosity. In contrast, it has been confirmed that, in the bell cup of Comparative Example 1, the average particle diameter difference is reduced as the rotation speed of the bell cup main body is increased, but the difference is still large as compared with Example 1.

Examples 4 to 6 and Comparative Examples 4 to 6

Coating was performed under the same condition using the same bell cups of Examples 1 to 3 and Comparative Examples 1 to 3 except that the coating material was an organic solvent-based middle coat coating material (ORGA OP-61M Sealer available from NIPPON PAINT AUTOMOTIVE COATINGS CO., LTD.) as substitute for the clear coating material, the three types of kinematic viscosities were 135 mPa·s, 121 mPa·s, and 110 mPa·s, the discharge rate of the middle coat coating material was 400 ml/min, and the rotation speed of the bell cup main body 30 was 20,000 rpm, and the average particle diameters at the time of coating were measured. The results are listed in Table 2.

TABLE 2

| | 135 mPa · s | 121 mPa · s | 110 mPa · s | Particle diameter difference μm | Determination |
|---|---|---|---|---|---|
| Example 4 | 43 | 49 | 51 | 8 | OK |
| Example 5 | 46 | 50 | 53 | 7 | OK |
| Example 6 | 45 | 51 | 54 | 9 | OK |
| Comparative Example 4 | 48 | 53 | 65 | 17 | NG |
| Comparative Example 5 | 51 | 54 | 70 | 19 | NG |
| Comparative Example 6 | 45 | 47 | 67 | 22 | NG |

Examples 7 to 9 and Comparative Examples 7 to 9

Coating was performed under the same condition using the same bell cups of Examples 1 to 3 and Comparative Examples 1 to 3 except that the coating material was an aqueous middle coat coating material (PROBLOCK N available from BASF Japan Ltd.) as substitute for the clear coating material, the three types of kinematic viscosities were 132 mPa·s, 117 mPa·s, and 101 mPa·s, the discharge rate of the middle coat coating material was 350 ml/min, and the rotation speed of the bell cup main body 30 was 20,000 rpm, and the average particle diameters at the time of coating were measured. The results are listed in Table 3.

TABLE 3

| | 132 mPa · s | 117 mPa · s | 101 mPa · s | Particle diameter difference μm | Determination |
|---|---|---|---|---|---|
| Example 7 | 30 | 33 | 35 | 5 | OK |
| Example 8 | 32 | 35 | 37 | 5 | OK |
| Example 9 | 28 | 30 | 34 | 6 | OK |
| Comparative Example 7 | 31 | 34 | 45 | 14 | NG |
| Comparative Example 8 | 33 | 36 | 45 | 12 | NG |
| Comparative Example 9 | 34 | 37 | 47 | 13 | NO |

From the results of Table 2 and Table 3, it has been confirmed that coating materials for which the bell cup according to one or more embodiments of the present invention is preferably used include clear coating materials as well as middle coat coating materials (organic solvent-based and aqueous ones) that are coating materials free from bright pigments.

DESCRIPTION OF REFERENCE NUMERALS

1 Rotary atomization-type coating device
- 11 Housing
- 12 Air motor
- 13 Hollow shaft
- 14 Coating material supply device
- 15 Feed tube
- 16 High-voltage power supply
- 17 Air ejection ports
- 18 Air supply device
- 19, 20 Air passage
- 21 Screw part

3 Bell cup

30 Bell cup main body
- 31 Coating material spreading surface
  - 31A First region (First coating material spreading surface)
  - 31B Second region (Second coating material spreading surface)
- 32 Outer surface
- 33 Distal end edge (End point of coating material spreading surface)
- 34, 35 Screw part
- 36 Annular convex part
- 37 Annular concave part

40 Bell hub
- 41 Through holes
- 42 Skirt part
- 43 Concave curved surface
- 44 Convex curved surface
- 45 Cleaning holes
- 46 Screw part

50 Diamond-like carbon film

CL Rotation center axis

The invention claimed is:

1. A bell cup of a rotary atomization-type coating apparatus having a rotary shaft and a feed tube inserted in the rotary shaft, the bell cup being fitted to a tip end part of the rotary shaft and having a coating material spreading surface on an inner surface of the bell cup, the feed tube discharging a coating material to the coating material spreading surface, the coating material spreading surface including a region extending from a predetermined position on a proximal end side to a distal end edge, the region comprising a convex curved surface toward an extension of the rotary shaft, wherein an outermost surface of at least part of the coating material spreading surface is covered with a diamond-like carbon film, and the diamond-like carbon film is composed of amorphous carbon that is free from silicon and contains fluorine and in which carbon atoms on its surface are not terminated with fluorine atoms.

2. The bell cup of a rotary atomization-type coating device according to claim 1, wherein the diamond-like carbon film is provided at least on the outermost surface of the convex curved surface.

3. The bell cup of a rotary atomization-type coating device according to claim 1, wherein the diamond-like carbon film is provided at least on the outermost surface of the coating material spreading surface at which an acute angle formed between a tangent line to the coating material spreading surface and the extension of the rotary shaft is 60° to 90°.

4. The bell cup of a rotary atomization-type coating device according to claim 1, wherein the bell cup is composed of aluminum, an aluminum alloy, titanium, or a titanium alloy and has an electroless metal plating film, a metal oxide film, or a silicon-containing diamond-like carbon film between a surface of the bell cup and the diamond-like carbon film.

5. The bell cup of a rotary atomization-type coating device according to claim 1, wherein the coating material is a coating material that is free from a bright pigment and subjected to electrostatic coating of a vehicle body of an automobile.

6. The bell cup of a rotary atomization-type coating device according to claim 5, wherein the coating material is a middle coat coating material or a top coat clear coating material applied to a vehicle body of an automobile.

7. The bell cup of a rotary atomization-type coating device according to claim 2, wherein the bell cup is composed of aluminum, an aluminum alloy, titanium, or a titanium alloy and has an electroless metal plating film, a metal oxide film, or a silicon-containing diamond-like carbon film between a surface of the bell cup and the diamond-like carbon film.

8. The bell cup of a rotary atomization-type coating device according to claim 3, wherein the bell cup is composed of aluminum, an aluminum alloy, titanium, or a titanium alloy and has an electroless metal plating film, a metal oxide film, or a silicon-containing diamond-like carbon film between a surface of the bell cup and the diamond-like carbon film.

9. The bell cup of a rotary atomization-type coating device according to claim 2, wherein the coating material is a coating material that is free from a bright pigment and subjected to electrostatic coating of a vehicle body of an automobile.

10. The bell cup of a rotary atomization-type coating device according to claim 3, wherein the coating material is a coating material that is free from a bright pigment and subjected to electrostatic coating of a vehicle body of an automobile.

11. The bell cup of a rotary atomization-type coating device according to claim 4, wherein the coating material is a coating material that is free from a bright pigment and subjected to electrostatic coating of a vehicle body of an automobile.

* * * * *